US008246345B2

(12) United States Patent
Schütz et al.

(10) Patent No.: US 8,246,345 B2
(45) Date of Patent: Aug. 21, 2012

(54) BURNER

(75) Inventors: Harald Schütz, Hennef (DE); Guido Schmitz, Bonn (DE)

(73) Assignee: Deutsches Zentrum fur Luft und Raumfahrt E.V., Cologne (DE)

( * ) Notice: Subject to any disclaimer, the term of this patent is extended or adjusted under 35 U.S.C. 154(b) by 246 days.

(21) Appl. No.: 12/672,158

(22) PCT Filed: Jul. 24, 2008

(86) PCT No.: PCT/EP2008/059744

§ 371 (c)(1),
(2), (4) Date: Feb. 4, 2010

(87) PCT Pub. No.: WO2009/019140

PCT Pub. Date: Feb. 12, 2009

(65) Prior Publication Data

US 2011/0229836 A1 Sep. 22, 2011

(30) Foreign Application Priority Data

Aug. 4, 2007 (DE) ..... 10 2007 036 953

(51) Int. Cl.
*F23M 9/00* (2006.01)

(52) U.S. Cl. ..... 431/181; 431/182

(58) Field of Classification Search ..... 431/181, 431/182

See application file for complete search history.

(56) References Cited

U.S. PATENT DOCUMENTS

| | | | | |
|---|---|---|---|---|
| 4,383,820 | A | 5/1983 | Camacho | |
| 6,383,462 | B1 * | 5/2002 | Lang | 423/235 |
| 6,572,366 | B2 * | 6/2003 | Eroglu et al. | 431/350 |
| 6,652,268 | B1 | 11/2003 | Irwin et al. | |

FOREIGN PATENT DOCUMENTS

| | | |
|---|---|---|
| DE | 2352204 | 4/1975 |
| DE | 4329237 | 3/1995 |
| EP | 1112972 | 8/1961 |
| EP | 0463218 | 11/1994 |
| EP | 1 096 202 | 5/2001 |

OTHER PUBLICATIONS

International Preliminary Report on Patentability corresponding to application No. PCT/EP2008/059744 Dated Mar. 11, 2010.
International Search Report for corresponding application No. PCT/EP2008/059744 dated Mar. 20, 2009.

* cited by examiner

*Primary Examiner* — Kenneth Rinehart
*Assistant Examiner* — William Corboy
(74) *Attorney, Agent, or Firm* — Renner, Otto, Boisselle & Sklar, LLP

(57) ABSTRACT

A burner having an inlet (10) and a mixing path (20) is designed such that the inlet (10) has a rectangular cross section. The mixing path (20) adjacent thereto has a round cross section and a larger diameter, thus forming four transitional steps (25). The transitional steps (25) form four secondary vortices, thus improving the distribution of the fuel in the radial direction. The burner provides combustion with low emission of hazardous substances, and with low emission of nitrogen oxides.

5 Claims, 3 Drawing Sheets

BURNER

Figure 1:
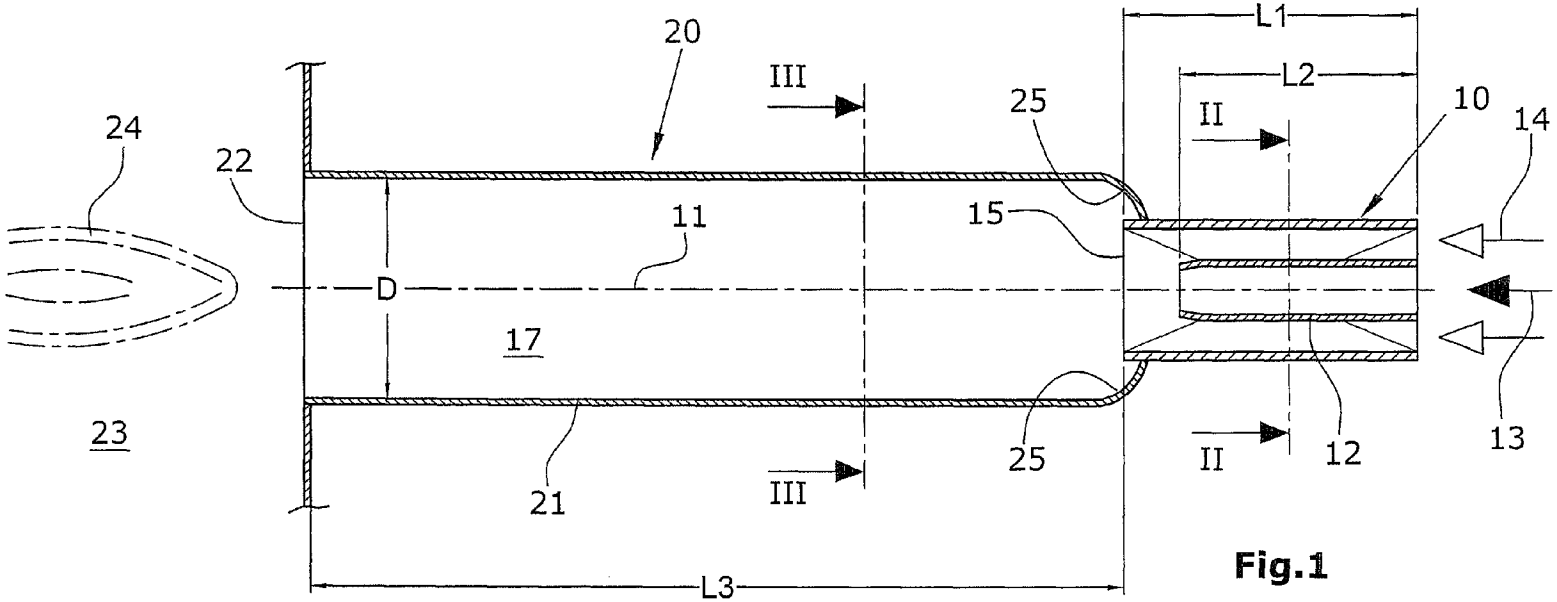

The invention relates to a burner comprising an inlet with intake ducts for fuel and air, and a mixing path following said inlet.

In EP 0 463 218 B1, a burner is described which comprises an inlet with coaxial intake ducts for fuel and air. Said burner inlet is followed by a mixing path wherein fuel and air are mixed with each other before the mixture will enter a combustion chamber. The fuel and the air have a flow pulse causing a combustion to take place only the combustion chamber.

DE 43 29 237 A1 describes a system for equalization of the dust load of a gas flow in a channel. For this purpose, a flow of a coal dust/carrier gas mixture is fed to a burner. According to one variant, a rectangular inflow conduit is provided which comprises lateral baffle elements as well as deflection and guide elements for guidance of the dust flow and for deflection of the gas flow into the middle of the inflow conduit. The inflow conduit is arranged to enter a cone which by its rear end surrounds the inflow conduit and in this region is provided with air intake ducts. The dust-air mixture passes through an air ring and is burned in a combustion chamber.

DE 23 52 204 A1 describes a cylindrical combustion chamber surrounded by a gas-inlet annular chamber and by a heat exchanger. The combustion gases issuing from the combustion chamber are passed through the heat exchanger. According to one embodiment, a rectangular burner and flame tube member can be combined with a cylindrical main combustion chamber, or a cylindrical burner and flame tube member can be combined with a rectangular main combustion chamber.

Described in EP 1 112 972 A1 is a burner device comprising a rectangular or round burner block surrounded by a nozzle ring discharging an inert gas. The inert gas generates, around the flame, an annular protective-gas wall of rectangular cross section.

A combustion device for pulverized coal is described in EP 0 672 863 A2. In this device, a throttle point is provided in the path of the fuel-air mixture for concentrating the flow.

During combustion, for reducing the $NO_x$ exhaust, it is important to achieve a good mixing of the fuel with the air and to keep the maximal combustion temperature as low as possible. The degree of intermixture in the outlet of the burner nozzle has quite an essential influence on the subsequent combustion processes in the combustion chamber. This holds true particularly for the nitrogen ($NO_x$) formation which for its part is decisively determined by the local combustion temperature (Zeldovich or thermic NO). Consequently, the objective of an optimal reduction of the nitrogen emission can be fulfilled in that, by suitable control of the mixing and burning processes, the combustion temperature is kept as low as possible ($T_{max}$<1750-1800K). This can be accomplished either by strong heat withdrawal in the combustion chamber that is effected through a heat exchanger, or by admixture of inert gases (air, $N_2$, Ar, . . . etc.) which will participate in the chemical reactions only as third bodies. In case of gas-turbine combustion chambers, the combustion temperature will be regulated by the burner with the aid of an excess of combustion air. The relevant key figure herein is the air number λ, formed by the molar air/fuel ratio in relation to the stoichiometric composition (λ=1). In case of a double excess of air, for instance, λ=2 will then apply. Within the burner itself, fuel and air will be merged and, initially, stoichiometric regions will be generated even in case of a high excess of air. The mixing behavior of a burner can now be characterized by the extent to which occurring λ-inhomogeneities in the burner will be reduced prior to their entrance into the combustion chamber. In the best case, one will obtain a homogeneous profile on the basis of the λ-value of the associated global mixture. The corresponding adiabatic combustion temperature of the global mixture can thus be considered to be the lower limit of the optimally reachable maximal combustion temperature, provided that no additional withdrawal of heat takes place. The degree of approximation to this ideal condition will characterize the mixing quality of each burner.

It is an object of the invention to provide a burner which has an improved mixing behavior for thus reducing the nitrogen formation.

The burner according to the invention is defined by claim 1. It comprises an inlet having a substantially rectangular cross section, wherein two parallel walls delimit a clear width: the mixing path defines a round channel having a width larger than said clear width between the parallel walls, thus forming transitional steps widening in the flow direction.

The invention allows for cross flows to be initiated at said transitional steps which are effective to improve the mixing process by increase of the turbulently diffuse transport and by the induction of a convective secondary transport. This is accomplished in that the combustion air will be transferred from a rectangular channel into a channel with round cross section. Said rectangular channel and said round channel are "in line", i.e. they are arranged on the same burner axis and, on their transitional surface, they form two mutually parallel steps (transitional steps). There is generated a convective-diffuse transport of the fuel-gas mixture and a strong and uniform spreading of the fuel also in the radial direction. The maximal fuel concentration at the outlet of the mixing path is thus small, and the distribution of the fuel over the cross section of the mixing channel is improved. As a result, there is achieved a reduction of thermal formation of oxygen. The transitional steps between the rectangular and the round cross sections will induce four secondary vortices, each of them rotating around a vortex axis extending parallel to the burner axis but at a radial displacement. Rotation of adjacent secondary vortices takes place in the opposite rotational sense.

Preferably, the size of the inlet rectangularly to the clear width is larger than the width of the channel. This means that the inlet laterally projects beyond the round channel. The cross-section ratio of that portion of the area of the inlet which is congruent with the round channel should be about ⅔ of the area of the round channel. The cross sections of the area of the inlet and of the area of the round channel should be substantially equal. The ratio of the lengths of the mutually rectangular sides of the inlet is preferably 2.5 to 3.5.

According to a preferred embodiment of the invention, the inlet includes a fuel lance terminating at a distance from the mixing path.

An embodiment of the invention will be explained in greater detail hereunder with reference to the drawings.

Figure 2:
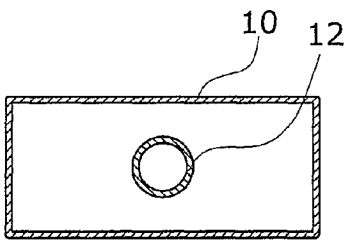
Figure 3:
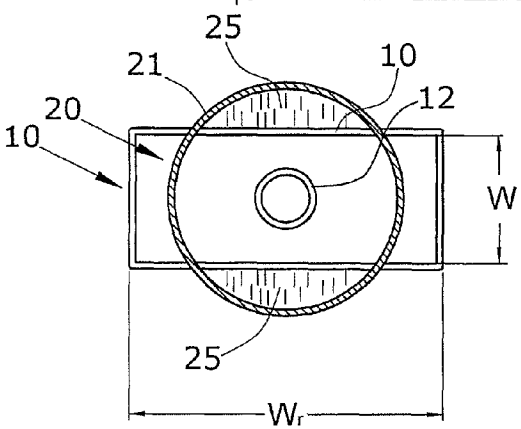
Figure 4:
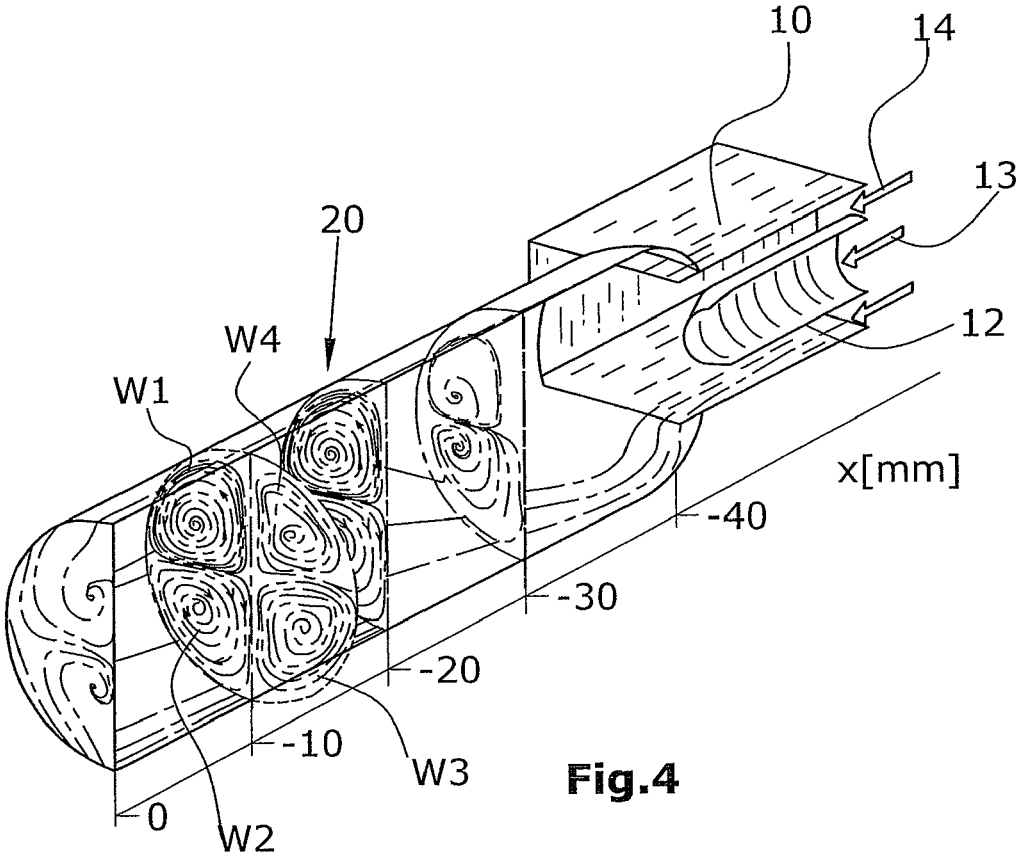
Figure 5:
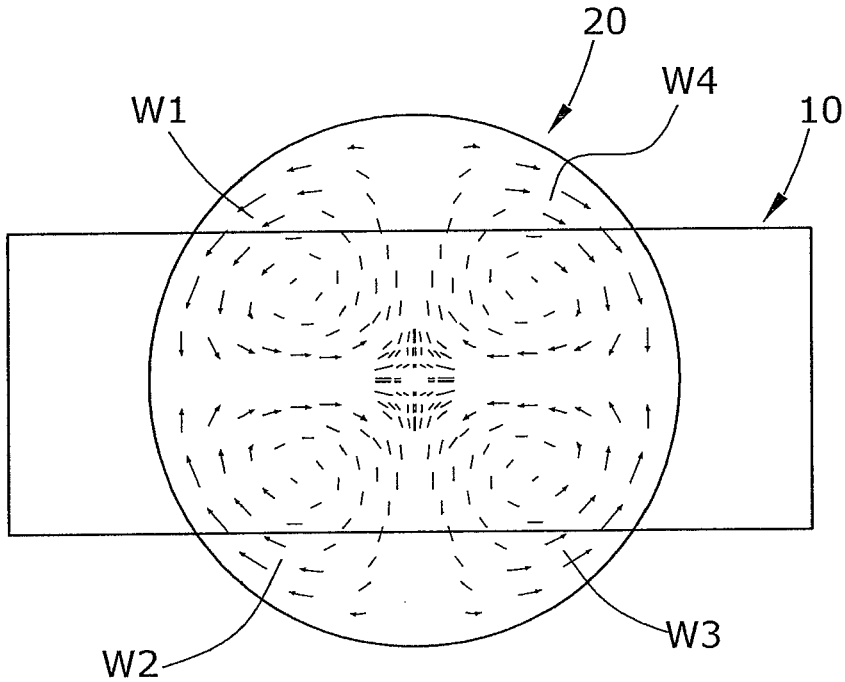
Figure 6:
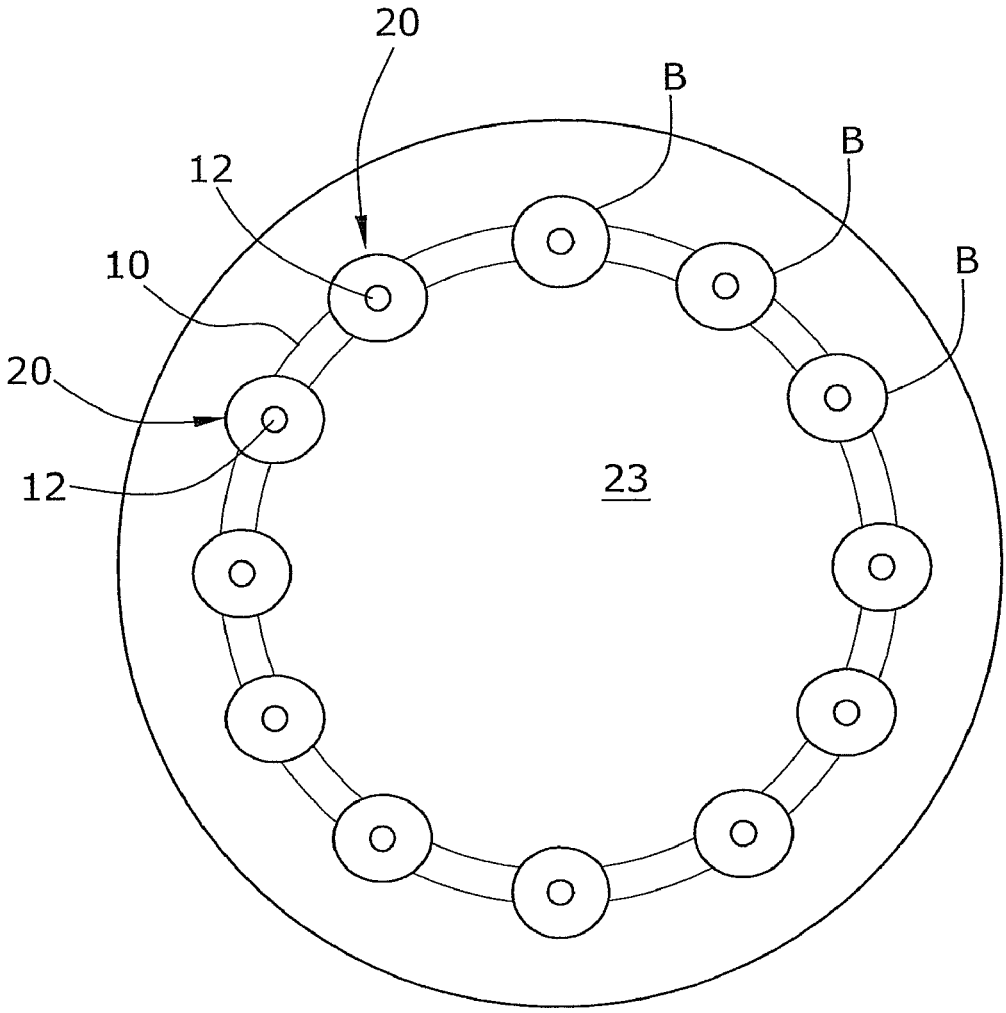

In the drawings, the following is shown:

FIG. 1 is a longitudinal sectional view of a burner according to the invention, FIG. 2 is a sectional view taken along the line II-II in FIG. 1, FIG. 3 is a sectional view taken along the line in FIG. 1, FIG. 4 is a perspective view of the four secondary vortices forming in the mixing chamber and propagating therein, FIG. 5 is a representation of the flow vectors in a transverse plane of the round channel, and FIG. 6 is an end view into the combustion chamber of a ring-type burner system comprising numerous burners.

The burner according to FIGS. 1-5 comprises an inlet 10 consisting of a tube having a substantially rectangular cross section. Said inlet 10 has two pairs of respectively parallel walls. Along the longitudinal axis of inlet 10 which forms the burner axis 11, a fuel lance 12 is arranged. Said lance consists of a tube with round cross section. Fuel lance 12 is fed with fuel 13 while the space of inlet 10 surrounding the fuel lance 12 is fed with air 14. The fuel used can be methane ($CH_4$), for instance. The fuel and the air alike are fed with high pressures. Fuel lance 12 terminates at a distance upstream of the exit end 15 of inlet 10.

Inlet 10 is followed by a mixing path 20. The latter consists of a tube 21 with round cross section, forming the channel. Said cylindrical tube 21 is arranged coaxially to the burner axis 17 and sealingly fastened to the exit end of inlet 10. The outlet end 22 of mixing path 20 is open. The mixing path is arranged to lead into a burner chamber 23 with a flame 24 generated therein.

The inner diameter D of tube 21 is larger than the clear width W of inlet 10 which is defined by the mutual distance of two parallel walls of the inlet. Thus, each of the four parallel walls of inlet 10 is formed, at the exit end 15 of the latter, with a transitional step 25 wherein the respective side wall has a receding shape in the flow path of the gas mixture. The walls of inlet 10 extend beyond the contour of channel 17 towards opposite sides. The surfaces of inlet 10 and of channel 17 have a mutual ratio of about 1:1. As evident from FIGS. 3 and 5, the cross-section ratio of that portion of the area of inlet 10 that is congruent with the round channel 17, amounts to about ⅔ of the area of the round channel 17. The dimension Wτ of inlet 10 at a right angle to the clear width W is larger than the width D of channel 17. This design of the channel has the effect that a radial impulse will be exerted on the mixture flow behind the exit end 15 of inlet 10. As a consequence of the four transitional steps 25, a total of four vortices—still to be explained hereunder—will be generated in the mixing tube at a distribution along the circumference.

In an embodiment realized in practice, the total length L1 of the inlet 10 is 14 mm, and the length of the fuel lance 12 is 11 mm so that the fuel lance terminates at a distance of 3 mm upstream of exit end 15. In this example, the length of the mixing path 20 is 30-40 mm.

FIGS. 4 and 5 illustrate the flow ratios in the mixing path 20. In a gas-turbine-relevant application, let it be assumed that the air number of the global mixture is λ-2.16. The air temperature is 720K, leading to an abiabatic flame temperature of about 1,750K. In case of an ideal, i.e. thorough mixing, this will result in an $NO_x$ emission of about 2 ppm. The development of the flow lines in FIG. 5 demonstrates that the flow from the rectangular inlet will preferably tend to stream into the step region with the largest step height. For reasons of continuity, this tendency is compensated for in the further course of the flow in the mixing path by the formation of four axially symmetrical secondary vortices W1-W4. Via the fuel lance 12 arranged on the burner axis, the fuel will be axially injected, at the height of the transitional steps 25, directly into the symmetry axis of these four secondary vortices. The described convective/diffuse transport generates a relatively strong and uniform spreading of the fuel in the radial direction. FIG. 4 further shows that the initial 100-percent concentration of $CH_4$ at the fuel inlet will be diluted to a value of maximally 8% (λ-1.2) on the burner axis in the cross section of the burner outlet. By contrast, a commercially available reference burner reveals a relatively high $CH_4$ concentration of about 13% (λ-0.7). The higher minimal λ-value in the region of the maximal fuel concentration will finally lead to locally considerably lower maximal temperatures in the combustion chamber. Thus, by the use of the presented novel burner concept, the potential for reduction of thermal nitrogen formation is markedly increased.

The secondary vortices W1-W4 are situated respectively in a quadrant of the cross section of mixing path 20. The rotational directions of two adjacent secondary vortices are opposite to each other. By the secondary vortex, the fuel will be carried to the outside, and the fuel distribution is homogenized. The transitional steps 25 will generate a speed component in the transverse direction.

FIG. 6 shows a ring burner system as used e.g. in stationary gas turbines. A large number of burners B of the above described type are arranged in an annular configuration, thus entering a common combustion chamber 23. The inlets 10 of the individual burners B are delimited against each other. The inlets are curved in such a manner that, in their totality, they form the annular structure.

The burner of the invention is particularly suited for use in gas turbines, notably those for energy generation as well as those for installation in aircraft. However, the burner is also useful for heating purposes.

The invention claimed is:

1. A burner comprising an inlet (10), said inlet (10) comprising intake ducts for air and for fuel and said intake duct for fuel comprising a fuel lance (12), said burner further comprising a mixing path (20) following said inlet (10) along a burner axis (11) and extending along said burner axis, said mixing path entering a combustion chamber (23) for generating a flame, said inlet (10) having a substantially rectangular cross section wherein two parallel walls delimit a clear width (W), and said mixing path (20) forming a round channel (17) of a width (D) larger than said clear width (W) between said parallel walls, and said mixing path (20) being sealingly connected to said inlet (10) to thereby form transitional steps (25) widening in the flow direction, and wherein the size (Wτ) of the inlet (10) rectangularly to said clear width (W) is larger than the width (D) of the channel (17).

2. The burner according to claim 1, wherein the cross-section ratio of that portion the area of the inlet (10) which is congruent with the round channel (17) is about ⅔ of the area of the round channel (17).

3. The burner according to claim 1, wherein the cross-section ratio of the area of the inlet relative to the area of the round channel is about 1:1.

4. The burner according to claim 1, wherein the ratio between the lengths of the sides of the inlet (10) is 2.5 to 3.5.

5. The burner according to claim 1, wherein said fuel lance (12) terminates at a distance upstream of the mixing path (20).

* * * * *

UNITED STATES PATENT AND TRADEMARK OFFICE

CERTIFICATE OF CORRECTION

PATENT NO. : 8,246,345 B2
APPLICATION NO. : 12/672158
DATED : August 21, 2012
INVENTOR(S) : Harald Schütz et al.

It is certified that error appears in the above-identified patent and that said Letters Patent is hereby corrected as shown below:

On the Title page, in column 1, associated with Assignee Item (73), "Deutsches Zentrum fur Luft und Raumfahrt E.V., Cologne (DE)" should be changed to --DEUTSCHES ZENTRUM FÜR LUFT – UND RAUMFAHRT E.V., Köln (DE)--.

Signed and Sealed this
Twenty-ninth Day of July, 2014

Michelle K. Lee

Michelle K. Lee
*Deputy Director of the United States Patent and Trademark Office*